United States Patent [19]

Clarke et al.

[11] Patent Number: 4,674,293

[45] Date of Patent: Jun. 23, 1987

[54] MARINE AIR CONDITIONING HEAT EXCHANGER

[75] Inventors: Alvin W. Clarke, Sarasota; Arville J. Collins, Bradenton, both of Fla.

[73] Assignee: Rotary Marine, Inc., Bradenton, Fla.

[21] Appl. No.: 869,181

[22] Filed: May 30, 1986

[51] Int. Cl.[4] ..... B63B 25/26

[52] U.S. Cl. ..... 62/240; 62/515; 62/525; 165/124

[58] Field of Search ..... 62/506, 240, 524, 525, 62/526, 515; 165/124

[56] References Cited

U.S. PATENT DOCUMENTS

| | | | |
|---|---|---|---|
| 3,097,507 | 7/1963 | Makuh | 165/144 X |
| 3,111,013 | 11/1963 | Ammons | 62/240 X |
| 3,540,229 | 11/1970 | Bunten | 62/240 |
| 3,721,104 | 3/1973 | Adler | 62/240 |
| 3,760,601 | 9/1973 | Bunten | 62/240 |
| 3,831,670 | 8/1974 | Mullings | 62/515 X |
| 4,470,271 | 9/1984 | Draper et al. | 165/124 X |
| 4,485,642 | 12/1984 | Karns | 62/525 X |
| 4,574,868 | 3/1986 | Anders | 165/124 X |

*Primary Examiner*—Lloyd L. King

*Attorney, Agent, or Firm*—Charles J. Prescott; Raymond H. Quist

[57] ABSTRACT

A heat exchanger for use in a marine air conditioning system is configured to provide the maximum possible heat transfer surface for the air being conditioned. The refrigerant coils and associated fins form the heat exchanger banks as usual, but instead of a single vertical bank, two banks are positioned at an angle to each other. This configuration provides a plenum which is more effective in causing air flow across through the entire heat exchanger configuration than is the case with the thin plenum associated with a single vertical bank. A housing for enclosing the heat exchanger is disclosed, which provides desired air passages.

17 Claims, 6 Drawing Figures

MARINE AIR CONDITIONING HEAT EXCHANGER

BACKGROUND OF THE INVENTION

1. Field of the Invention

This invention relates generally to marine air conditioning, and more particularly to am improved heat exchanger for marine applications.

2. Description of Related Art

Boats and small ships are limited in the space available for not only the passengers, but also all equipment, fittings, etc. This limitation has resulted in some cases with apparatus which is inadequate to satisfactorily perform its function. As an example, the space alloted for air conditioning units on some boats necessitates the use of equipment which will not adequately cool the cabin volume. A limiting component in an air conditioning system which determines its capacity is the heat exchanger which transfers heat from the cabin air to the refrigerant; and, in the case of a heat pump, to the cabin air from the refrigerant. Such heat exchangers have a plane front surface, and height and width dimensions sized to fit the opening in which the unit will be placed. These air conditioners also have a thin plenum which is immediately behind the heat exchanger and has the same configuration as the heat exchanger. The resulting air flow through this heat exchanger and plenum combination is found to be primarily in the region opposite to the plenum exhaust (which is the intake to the blower). The thin plenum used in conventional marine air conditioning heat exchangers is ineffective in conveying air to this exhaust from all regions of the plane surface of the back of the heat exchanger. So that a significant portion of the heat exchanger is ineffective in providing heat exchange with the air.

The present marine air conditioning system provides a heat exchanger and plenum configuration providing increased heat exchanger area within the rectangular opening available for use, and improves air flow through the entire increased heat exchanger area.

It is therefore an object of this invention to provide a marine air conditioning system which provides a greater air conditioning capacity within the available space than previous air conditioners.

It is a further object of this invention to provide a heat exchanger for a marine air conditioning system which uses readily available, rectilinear configured, fin and tube elements.

In accordance with these and other objects, which will become apparent hereafter, the instant invention will now be described with reference to the accompanying drawings.

SUMMARY OF THE INVENTION

This invention is a heat exchanger for use in a marine air conditioning system. The heat exchanger is used to extract heat from, or add heat to, the cabin air, with the air conditioner refrigerant serving as the other fluid medium. The heat exchanger will be positioned within some type of passage or space which will admit air to the inlet side of refrigerant coils with their associated heat conducting fins. The walls of the passage or compartment may serve as part of the air conveying passage for the heat exchanger, or a housing is used to to convey air to the coil and fin arrangement. A greater area of fins is exposed to the air in this invention by forming the refrigerant coils and associated fins in two banks arranged at an angle to each other. Each bank has the ordinary, readily available rectilinear configuration. A plenum is formed on the outlet side of the coil and fin arrangements which aids in conveying air through all parts of the heat exchanger fin passages.

DETAILED DESCRIPTION OF THE INVENTION

Figure 1:
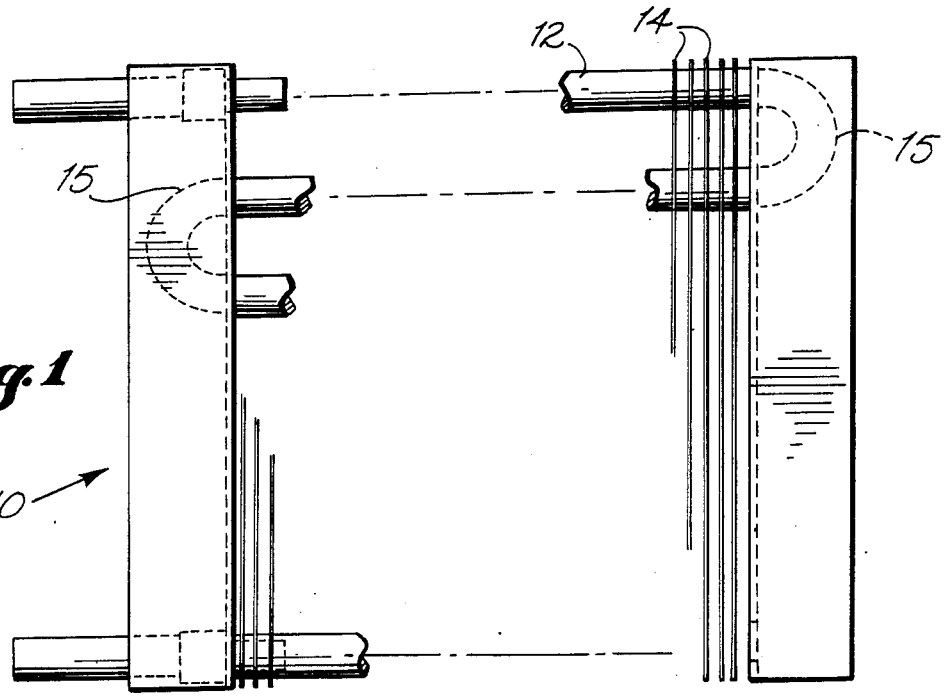
FIG. 1 is a front elevation of a heat exchanger bank of the type used in the invention.
Figure 2:
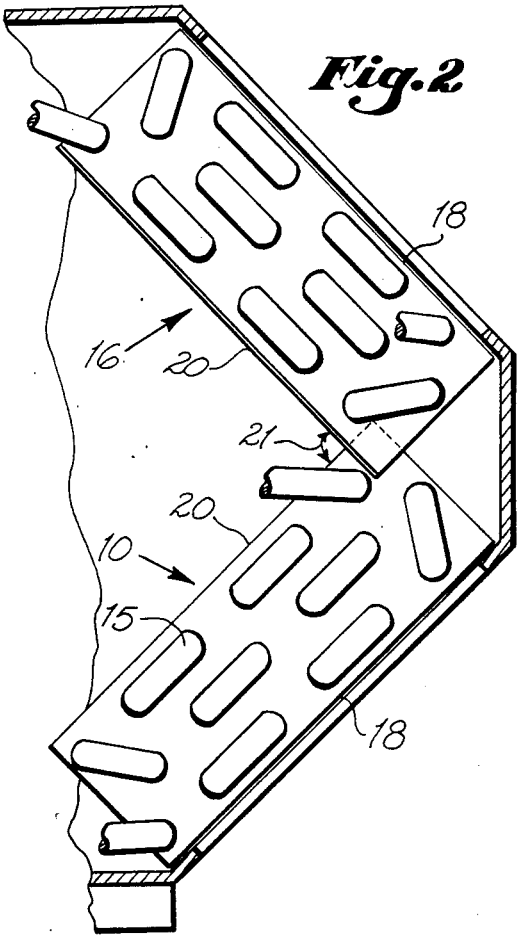
FIG. 2 is a side elevation of one embodiment of a heat exchanger in accordance with the invention.
Figure 3:
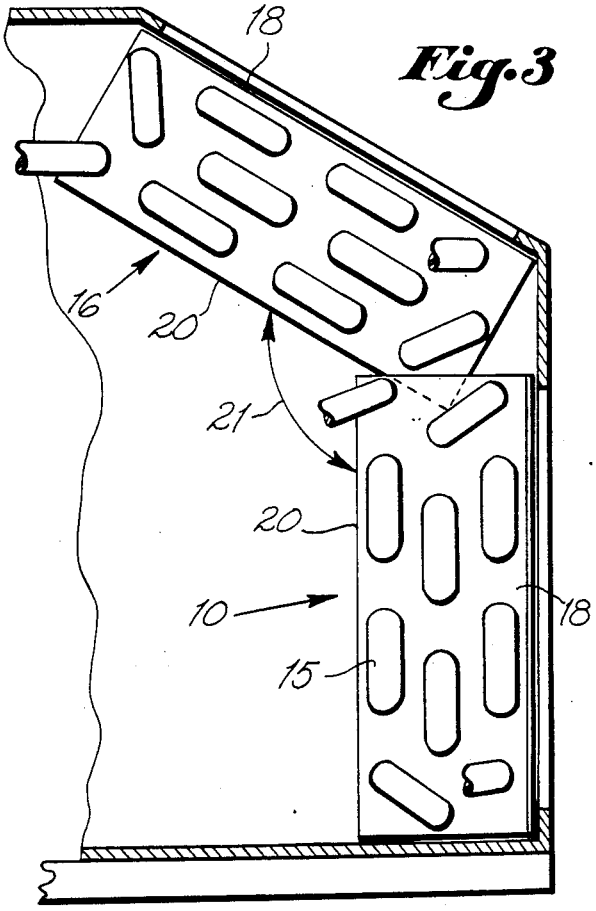
FIG. 3 is a side elevation of another embodiment of a heat exchanger in accordance with the invention.

Referring to FIGS. 1–3, a first heat exchanger bank 10 is shown having a coil formed by a continuous serpentine tube 12 for conveying refrigerant passing, in heat conducting relationship, through an array of parallel metal plates or fins 14. The tube is straight where it passes through fins 14 and has recurved bends 15 at each end. Heat exchanger bank 10 will be referred to as rectilinear since its perimeters may be bounded by straight lines. It is intended by the term rectilinear to define a conventional structure available from a number of commercial sources. A second heat exchanger bank 16 is also shown in FIGS. 2 and 3. Heat exchanger bank 16 is also rectilinear. In the embodiment built, heat exchanger banks 10 and 16 were identical, however, it will be recognized that it would be possible to carry out the principles of this invention if two non-identical heat exchanger banks are used.

As will be recognized as conventional, heat exchanger banks 10 and 16 have an air inlet side 18 and an air outlet side 20. Cabin air which is to be heated or cooled is caused to be passed through the fins 14 of the heat exchanger banks from the inlet to the outlet. A blower of some type, normally located on the outlet side causes the air to flow.

Figure 6:
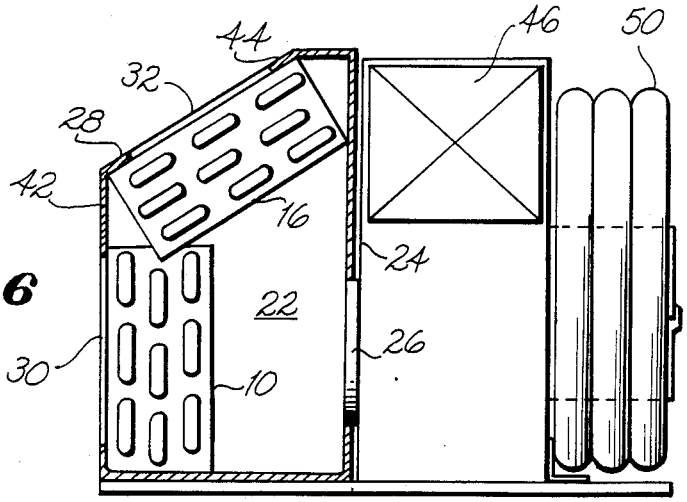
FIG. 6 is a side elevation, partially in cross-section, of the marine air conditioning unit of FIG. 4.

In accordance with the invention, heat exchanger bank 10 and heat exchanger bank 16 are positioned relative to each other so that the planes defining their outlets form a dihedral angle 21. This positioning permits a greater heat exchange area to be contained within the fixed height and width which is available for this purpose than would be the case if a single rectilinear heat exchanger positioned vertically in that area were used. This positioning has an additional beneficial effect. Referring to FIG. 6, plenum 22, formed between the air outlet sides of heat exchanger banks 10 and 16, and partition or rear wall 24 has been found to convey air efficiently to plenum exhaust 26. The effectiveness of the present arrangement is easily demonstrated by placing a paper strip adjacent to various areas on the inlet sides of heat exchanger banks 10 and 16. The paper is drawn tightly against the fins 14 in all locations. The same demonstration performed on a single heat exchanger bank, of the type generally commercially available, shows areas having insufficient air flow to support the paper. In both cases, it should be understood, the plenum exhaust is off to one side. This assymetrical positioning requires that much of the air must take an indirect route to the exhaust. It is hypothesized that having a plenum in which the crosssectional (viewed from the side) height and width are more equal facilitates the air flow, as opposed to the conventional plenum which is tall and narrow.

It will be recognized that the effectiveness of the heat exchanger banks would be diminished if air could bypass the banks while being drawn to the intake of the blower. One mode of assuring that all air will pass through fins 14 of the heat exchanger banks is the provision of a housing such as housing 28 of FIGS. 4–6. Housing 28 has a front surface configured to conform to the front surfaces of rectilinear heat exchange banks 10 and 16, with openings 30 and 32 forming air intakes for the immediately adjacent inlet sides of heat exchanger banks 10 and 16 respectively. Housing 28 is fabricated to have horizontal base 34, rear wall 24, side walls 36 and 38, horizontal top 40, and a front wall having two surfaces 42 and 44. The front wall surfaces are given angles (with respect to the normally horizontal surfaces of the enclosure within which housing 28 will reside) which are the same as those of the inlet sides of the adjacent heat exchanger fins.

As shown in FIGS. 2 and 3, the two banks may overlap to a certain extent by intermeshing the fins 14 of the two banks. The dihedral angle 21 between the two banks may also be varied. Although it is contemplated that a single heat exchanger with a bend could be substituted for the two banks, it is considered that such an arrangement is—effectively—two banks. Forming the heat exchanger from two identical coil and fin components permits potential savings by greater volume purchases and also permits varying the dihedral angle for different applications.

The arrangement shown in FIG. 2, shows a 90 degree dihedral angle, while the arrangement shown in FIG. 3, shows a 120 degree dihedral angle. The 90 degree dihedral angle results in a somewhat smaller overall vertical distance than the 120 degree dihedral angle. It should be recognized that the vertex of the dihedral angle may extend horizontally, as shown, or may also extend vertically. It will be observed that when a housing is employed, the air inlets of the housing limit the location of the periphery of the fins where air can enter. The air will not necessarily leave the fins at a point directly opposite its entry point. The side of the coil and fin bank is designated as an inlet plane herein, and the side of the coil and fin bank opposite to this inlet plane is designated the outlet plane, even though some air may leave the fins at points outside the outlet plane.

In some applications, a housing for the heat exchanger may not be required. Where the marine air conditioning heat exchanger or total system is housed in a rectilinear passage, the walls of the passage may serve to convey air to the heat exchanger.

Housing 28, provides around its bottom edge a lip or rim which is part of the housing walls, and which serves to contain the condensate which will form when the heat exchanger is being used to cool air. This is conventional, as is a condensate drain (not shown) which carries the condensate to the bilges.

Figure 4:
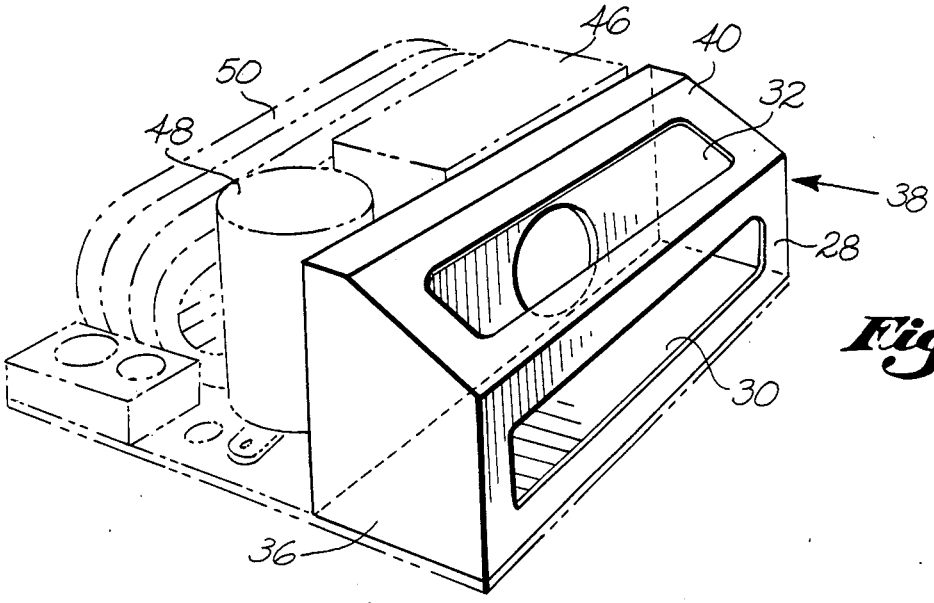
FIG. 4 is a perspective view of a marine air conditioning unit, partially in phantom view, with the housing for a heat exchanger.
Figure 5:
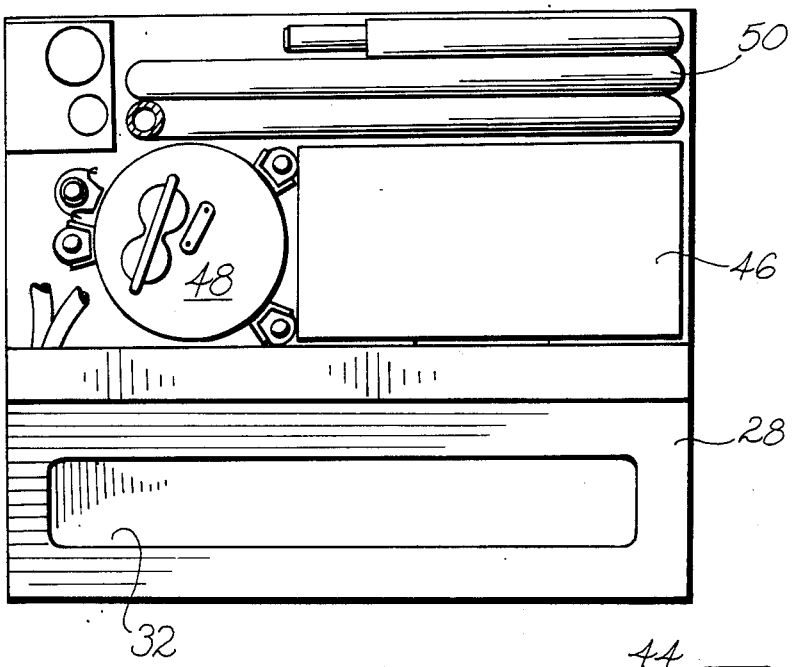
FIG. 5 is a top view of the marine air conditioning unit of FIG. 4.

As shown in FIGS. 4–6, the air heat exchanger is a component a marine air conditioning unit. These illustrations are provided to show one arrangement for the major components of such a unit. Blower 46, compressor 48 and sea water to refrigerant heat exchanger 50 are the other large components of the unit. These components are commercially available with external dimensions small enough so that they will not extend higher than the air heat exchanger. Thus the increased heat transfer capacity afforded by the heat exchanger of this invention results from the heat exchanger configuration used in this invention. It will be noted that the heat exchanger achieves a lower height (in FIG. 6, for example) by having a greater depth. This depth is not a problem as the unit is normally positioned in the boat in a location such as under a sofa, where adequate depth is available.

It has been found useful to use a parallel flow path for the refrigerant to the two banks of heat exchanger coils and associated fins 10 and 16. Since each bank is fabricated having a separate tube, this flow path is easily implemented. Metering orifices having a two-way flow capability are used in a paired arrangement so that flow of the refrigerant can be in either direction, depending upon whether air cooling or heating is desired. These orifices are available from Chatloff Controls, Inc. of Austin, Tex.

While the instant invention has been shown and described herein in what is conceived to be the most practical and preferred embodiments, it is recognized that departures may be made therefrom within the scope of the invention, which is therefore not to be limited to details disclosed herein, but is to be afforded the full scope of the claims so as to embrace any and all equivalent apparatus and articles.

We claim:

1. In a marine air conditioning system having a refrigerant as an operating medium, a compressor, a first heat exchanger for transferring heat between the air conditioner refrigerant and sea water, and an expansion valve; an improved heat exchanger for transferring heat between the air conditioner refrigerant and the ambient air comprising:

a housing having a horizontal base, a rear wall, two side walls, a horizontal top, and a front wall;

first and second air intakes located in said front wall;

a first bank of refrigerant coils and associated heat conducting fins positioned adjacent to said first air intake, whereby all air entering said first air intake will pass between said fins of said first bank;

the edges of said fins adjacent to said first air intake defining an inlet plane of said first bank, and the edges of said fins opposite to said inlet plane defining an outlet plane of said first bank, a second bank of refrigerant coils and associated heat conducting fins positioned adjacent to said second air intake, whereby all air entering said second air intake will pass between said fins of said second bank;

the edges of said fins adjacent to said second air intake defining an inlet plane of said second bank, and the edges of said fins opposite to said inlet plane defining an outlet plane of said second bank;

said first and second banks positioned relative to each other so that their outlet planes form a dihedral angle of less than 180 degrees;

a plenum within said housing defined by said base, said rear wall, said side walls and the outlet planes of said first and second banks; and an air exhaust in said rearwall.

2. An improved heat exchanger in accordance with claim 1 wherein:

said dihedral angle is from 90 to 120 degrees.

3. An improved heat exchanger in accordance with claim 1 wherein:

said dihedral angle is 120 degrees, and one of said first and second banks of refrigerant coils and associated fins is vertically oriented.

4. An improved heat exchanger in accordance with claim 1 wherein:

said dihedral angle is 90 degrees, and the inlet planes of said banks are at an angle of 45 degrees with the horizontal.

5. In a marine air conditioning system having a refrigerant as a heat transfer medium, a compressor, a first heat exchanger for transferring heat between the air conditioner refrigerant and sea water, and an expansion valve; an improved heat exchanger for transferring heat between the air conditioner refrigerant and the ambient air, said heat exchanger sized to be positioned within a rectilinear passage defined by walls forming an inlet air duct for said heat exchanger comprising:

a first rectilinear bank of refrigerant coils and associated heat conducting fins;

said first rectilinear bank having an air inlet side and an air outlet side, and said air inlet side and air outlet side defining spaced apart planes;

a second rectilinear bank of refrigerant coils and associated heat conducting fins;

said second rectilinear bank having an air inlet side and an air outlet side, and said air inlet side and air outlet side defining spaced apart planes;

said first and second rectilinear banks positioned relative to each other so that their outlet planes form a dihedral angle of less than 180 degrees;

a plenum wall sized to extend to said walls of said rectilinear passage;

said plenum wall positioned on the outlet side of said first and second banks;

said plenum wall, said walls of said rectilinear passage and said outlet planes of said first and second banks forming a plenum for said heat exchanger; and an air exhaust in one of said walls forming said plenum.

6. An improved heat exchanger in accordance with claim 5 wherein:

said dihedral angle is from 90 to 120 degrees.

7. An improved heat exchanger in accordance with claim 5 wherein:

said dihedral angle is 120 degrees, and one of said first and second banks of refrigerant coils and associated fins is vertically oriented.

8. An improved heat exchanger in accordance with claim 5 wherein:

said dihedral angle is 90 degrees, and the inlet planes of said banks are at an angle of 45 degrees with opposite walls of said walls of said rectilinear passage.

9. A marine air conditioner heat exchanger comprising:

a first rectilinear bank of refrigerant coils and associated heat conducting fins;

said first rectilinear bank having an air inlet side and an air outlet side, and said air inlet side and said air outlet side defining spaced apart air inlet and air outlet planes;

a second rectilinear bank of refrigerant coils and associated heat conducting fins;

said second rectilinear bank having an air inlet side and an air outlet side, and said air inlet side and said air outlet side defining spaced apart air inlet and air outlet planes;

said first and second rectilinear banks positioned relative to each other so that said air outlet planes form a dihedral angle of less than 180 degrees;

a housing having a horizontal base, a rear wall, two side walls, a horizontal top, and a front wall enclosing said first and second banks; and said housing front wall has first and second air intakes positioned adjacent to said air inlet sides of said first and second rectilinear banks.

10. An improved heat exchanger in accordance with claim 9 wherein:

said dihedral angle is from 90 to 120 degrees.

11. An improved heat exchanger in accordance with claim 9 wherein:

said dihedral angle is 120 degrees.

12. An improved heat exchanger in accordance with claim 9 wherein:

said dihedral angle is 90 degrees.

13. An improved heat exchanger in accordance with claim 9 wherein:

said housing has an air exhaust in said rear wall.

14. An improved heat exchanger in accordance with claim 9 wherein:

said housing is fabricated of plastic.

15. An improved heat exchanger in accordance with claim 9 wherein:

the coils in each of said banks are straight tubes within said associated heat conducting fins and have bends at the ends.

16. An improved heat exchanger in accordance with claim 15 wherein:

the coil in each bank has one inlet and one outlet.

17. An improved heat exchanger in accordance with claim 16 wherein:

both banks are identical.

* * * * *